US007654057B2

(12) United States Patent
Zambelli et al.

(10) Patent No.: US 7,654,057 B2
(45) Date of Patent: Feb. 2, 2010

(54) ANCHORING INSERT FOR EMBEDDING IN A CONCRETE COMPONENT AND CONCRETE COMPONENT PROVIDED THEREWITH

(76) Inventors: Sergio Zambelli, Via Stezzano, 28, 24050 Zanica (IT); Benito Zambelli, Via Roma, 44, 24050 Zanica (IT)

( * ) Notice: Subject to any disclaimer, the term of this patent is extended or adjusted under 35 U.S.C. 154(b) by 231 days.

(21) Appl. No.: 11/198,238

(22) Filed: Aug. 8, 2005

(65) Prior Publication Data

US 2007/0039281 A1 Feb. 22, 2007

(51) Int. Cl.
*E04C 5/00* (2006.01)
*F16B 39/00* (2006.01)

(52) U.S. Cl. ..... 52/710; 52/704; 411/82

(58) Field of Classification Search ..... 52/710, 52/702, 704, 707, 125.4, 125.5, 576; 411/82, 411/84

See application file for complete search history.

(56) References Cited

U.S. PATENT DOCUMENTS

| | | | | | |
|---|---|---|---|---|---|
| 1,430,931 | A * | 10/1922 | Blackall | 52/36.4 |
| 1,756,174 | A * | 4/1930 | Bosco | 52/710 |
| 1,929,835 | A * | 10/1933 | Awbrey | 52/709 |
| 2,087,941 | A * | 7/1937 | Weaver | 52/710 |
| 2,108,107 | A * | 2/1938 | De Wees | 52/701 |
| 2,165,882 | A * | 7/1939 | Birch | 52/706 |
| 2,181,740 | A * | 11/1939 | Reiland | 52/710 |
| 2,780,936 | A * | 2/1957 | Hillberg | 52/710 |
| 3,005,292 | A * | 10/1961 | Reiland | 52/99 |
| 3,667,174 | A * | 6/1972 | Arnett | 52/100 |
| 4,040,228 | A * | 8/1977 | Skubic | 52/710 |
| 4,389,830 | A * | 6/1983 | Ingeberg | 52/710 |
| 4,532,740 | A * | 8/1985 | Fricker | 52/98 |
| 4,708,554 | A * | 11/1987 | Howard | 411/84 |
| 4,948,313 | A * | 8/1990 | Zankovich | 411/85 |
| 5,386,675 | A * | 2/1995 | Baur et al. | 52/250 |
| 5,548,939 | A * | 8/1996 | Carmical | 52/707 |
| 5,970,675 | A * | 10/1999 | Schray | 52/582.1 |
| 6,305,650 | B1 * | 10/2001 | Hawkins et al. | 248/68.1 |
| 7,237,368 | B2 * | 7/2007 | Richardson et al. | 52/707 |
| 2003/0217521 | A1 * | 11/2003 | Richardson et al. | 52/92.2 |

FOREIGN PATENT DOCUMENTS

| | | |
|---|---|---|
| DE | 85 01 359 U1 | 5/1986 |
| DE | 100 14 977 A1 | 9/2001 |
| DE | 103 06 511 B3 | 7/2004 |
| GB | 399 581 A | 10/1933 |

* cited by examiner

*Primary Examiner*—Richard E Chilcot, Jr.
*Assistant Examiner*—Brent W Herring
(74) *Attorney, Agent, or Firm*—Modiano & Associati; Albert Josif; Daniel J. O'Byrne

(57) ABSTRACT

A concrete component embedded anchoring insert for bracing panels in buildings, and prefabricated concrete component provided therewith, the anchoring insert comprising an insert body delimiting a compartment and having a face with a main access opening. The insert body can be embedded in the concrete component so that the face is substantially flush with a face of the concrete component. A connecting element can be inserted in the main opening. The insert body has at least one secondary opening allowing concrete of the component body to enter the compartment, and a protection provided in the compartment adapted to prevent the concrete from accessing a portion of the compartment which is designed to receive the connecting element.

14 Claims, 4 Drawing Sheets

ANCHORING INSERT FOR EMBEDDING IN A CONCRETE COMPONENT AND CONCRETE COMPONENT PROVIDED THEREWITH

The present invention relates to an anchoring insert to be embedded in prefabricated concrete components, particularly for bracing panels in buildings or for anchoring other elements, such as rails, utility raceways, machines or the like, to the component, and to a prefabricated concrete component provided with such anchoring insert.

BACKGROUND OF THE INVENTION

Anchoring inserts are known which are designed to be embedded within prefabricated concrete components and are also known commonly as "slotted inserts" or more simply as "slots".

These anchoring inserts are generally constituted by a box-like body, obtained simply by bending a metal plate or provided by welding a plurality of appropriately shaped metal plates, which generally has a substantially flat face, usually with a rectangular plan shape, crossed by an elongated slot. Such box-like body is embedded, during the manufacture of the prefabricated concrete component, within the body of the component so that the slotted face is substantially coplanar with respect to one of the faces of the component while the remaining part of the box-like body is embedded within the body of the article.

The function of these anchoring inserts is to provide coupling points, along the extension of the prefabricated component, for connecting elements, usually constituted by bolts, for other parts, generally other prefabricated concrete components or rails, utility raceways, machines or the like, in the construction of buildings. Typically, inserts of this type are used to connect, by means of bolt-type elements, the prefabricated panels of the face of a building to the back structure of the building.

One fundamental technical problem in the design of these inserts is to achieve the intended resistance of the insert to separation from the component in which it is embedded, with a minimal depth of the insert, where depth is the dimension of the insert at right angles to the face of the component that supports the insert and generally is the dimension of the insert along the thickness of the component.

A reduced depth of the insert, for an equal performance, in fact allows to use the same insert for a wide range of components and reduces the problems linked to its embedding in the component.

Currently, in order to meet this need, inserts have been provided which have particular shapes so as to increase as much as possible the surface of contact between the insert and the concrete and/or so as to provide, on the outer surface of the insert, adequate anchoring undercuts for the concrete.

Moreover, various types of accessories to be associated with the insert before its embedding in the body of the component have been developed, such as for example riveting shoes, rivets, screws, ribbed rods to be inserted through holes of the insert, brackets to be welded to the body of the insert, et cetera. These accessories protrude from the body of the insert, and by being embedded in the concrete of the body of the component increase the cohesion between the insert and the component, thus increasing the resistance of the insert to separation from the component.

All these refinements suffer the drawback of complicating the manufacture of the insert and often do not allow to combine a preset resistance to separation with the intended depth for the insert.

SUMMARY OF THE INVENTION

The aim of the present invention is to solve the problems described above by providing an anchoring insert to be embedded in prefabricated concrete components which, for an equal depth and shape, can have a higher resistance to separation from the component with respect to known types of anchoring inserts.

Within this aim, an object of the invention is to provide an anchoring insert which can be manufactured at extremely competitive costs and is simple to use.

Another object of the invention is to provide an anchoring insert which can ensure high resistance to separation from the component even without requiring additional elements.

Another object of the invention is to provide an insert which, by being able to have a reduced depth with respect to its resistance to separation, can be used for a wide range of components, including low-thickness components.

This aim and these and other objects which will become better apparent hereinafter are achieved by an anchoring insert to be embedded in prefabricated concrete components, particularly for bracing panels in buildings or for anchoring other elements to the component, comprising an insert body which delimits a compartment and has a face provided with a main opening for accessing said compartment, said insert body being embeddable in a concrete component so that said face is substantially flush with a face of said concrete component, a connecting element being insertable in said main opening, characterized in that said insert body has at least one secondary opening which is adapted to allow the concrete of said component to enter said compartment, protection means being provided which can be inserted in said compartment and are adapted to prevent the concrete of the component from accessing a portion of said compartment which is connected to said main opening and is designed to receive said connecting element.

BRIEF DESCRIPTION OF THE DRAWINGS

Further characteristics and advantages of the invention will become better apparent from the description of a preferred but not exclusive embodiment of the anchoring insert according to the invention, illustrated by way of non-limiting example in the accompanying drawings, wherein.

DESCRIPTION OF THE PREFERRED EMBODIMENTS

Figure 1:
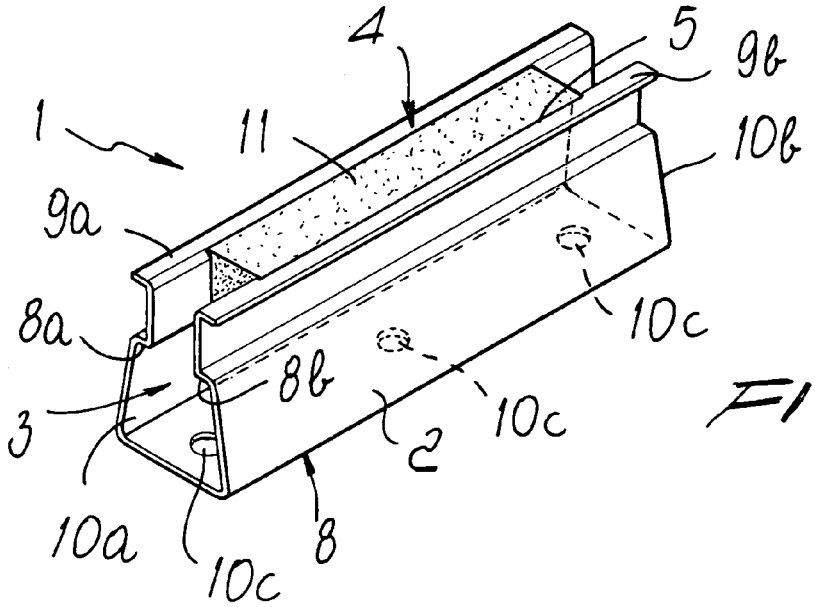
FIG. 1 is a perspective view of an anchoring insert according to the invention with the protection means.
Figure 2:
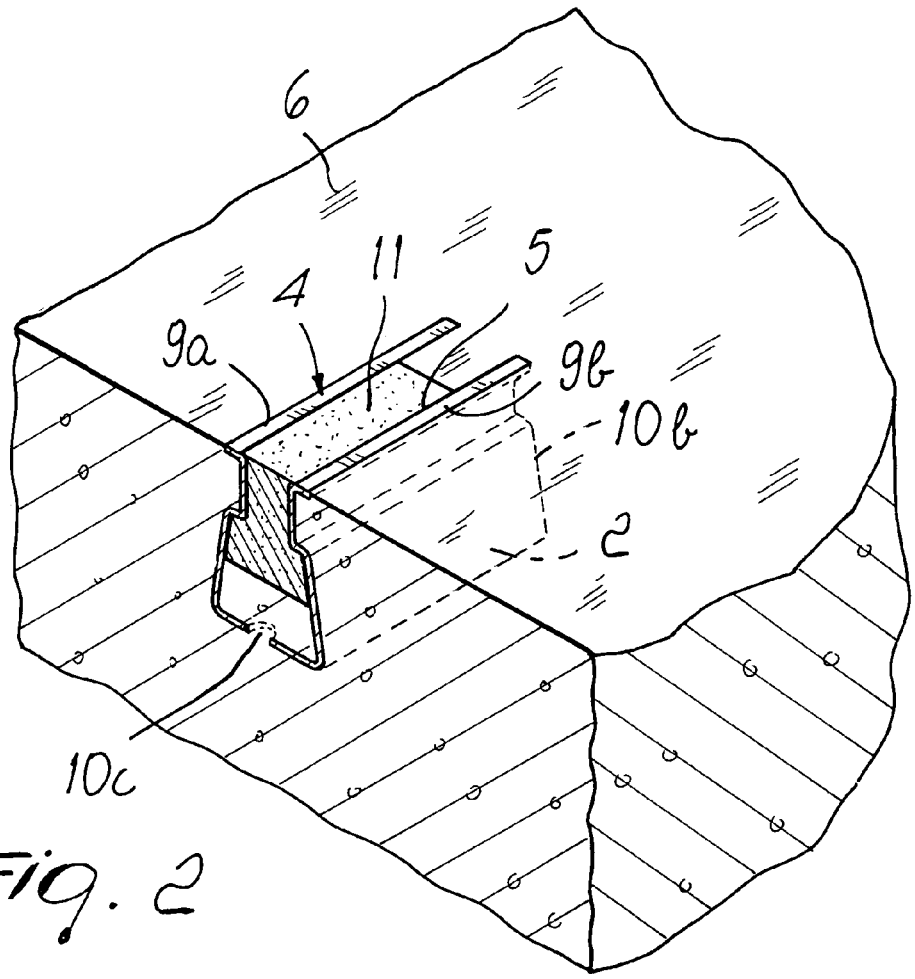
FIG. 2 is a partially sectional perspective view of a concrete component, taken at an anchoring insert according to the invention provided with the protection means.

With reference to the figures, the anchoring insert according to the invention, generally designated by the reference numeral 1, comprises an insert body 2, which delimits a compartment 3 and is provided with a face 4 in which there is a main opening 5, which allows access to the compartment 3.

The anchoring insert 1 is designed to be embedded in the body of a concrete component 6 so that the face 4 is substantially flush with one face of the component and so that the remaining part of the insert is embedded in the body of the component 6.

Figure 4:
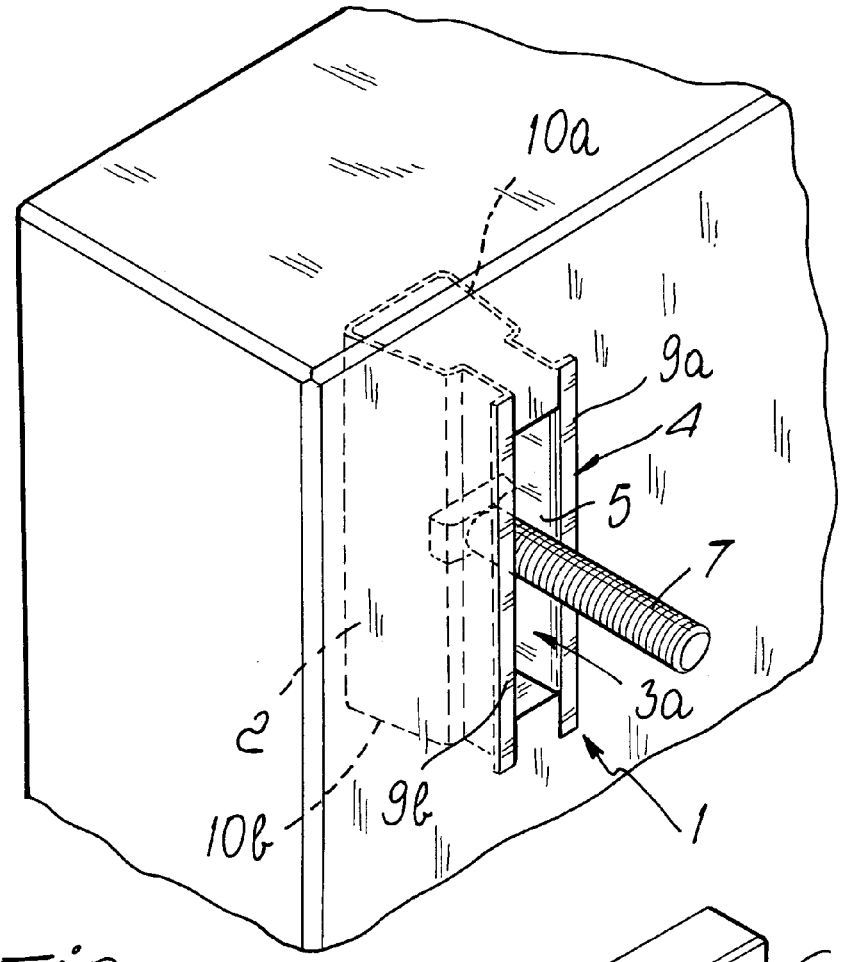
FIG. 4 is an enlarged-scale view of a detail of FIG. 3 with a connecting element engaged in an anchoring insert.
Figure 3:
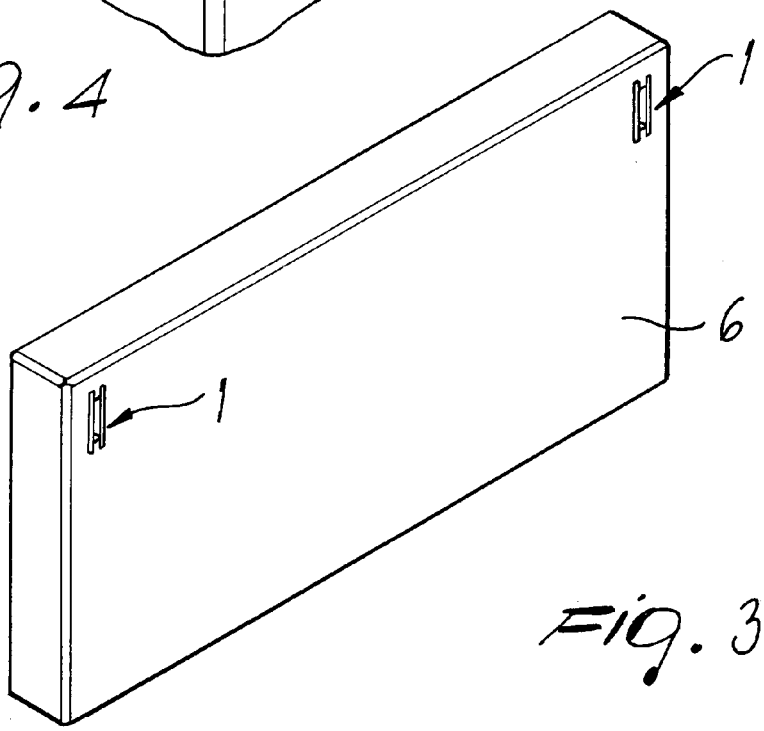
FIG. 3 is a perspective view of a prefabricated concrete panel with two anchoring inserts according to the invention.
Figure 5:
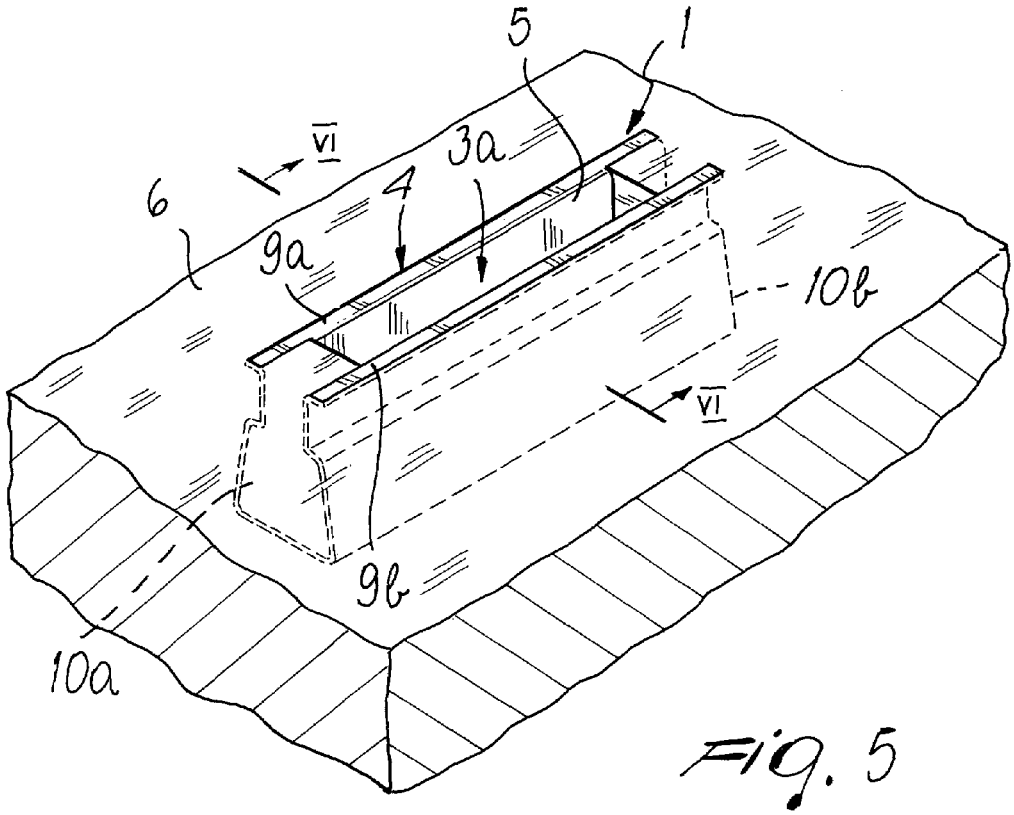
FIG. 5 is a perspective view of a portion of a concrete component with an anchoring insert according to the invention.
Figure 6:
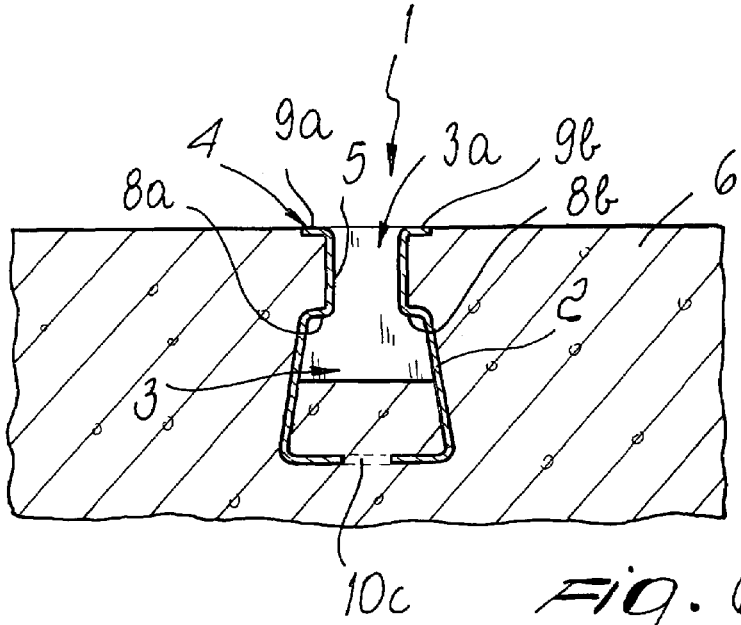
FIG. 6 is a sectional view of FIG. 5, taken along the line VI-VI.

It is possible to insert in the main opening 5, when the anchoring element 1 is embedded in the component 6, a connecting element 7 in order to connect the component 6 to other parts of a building. FIG. 4 illustrates a connecting element 7 constituted by the threaded portion of a bolt with a T-shaped head, but the connecting element 7 can also be constituted by a different connecting element of a known type.

According to the invention, the body of the insert 2 has at least one secondary opening, which during the manufacture of the component 6, i.e., during the casting of the concrete, is adapted to allow the concrete to enter the compartment 3 so that it is occupied partially by the concrete. Complete filling of the compartment 3 by the concrete is prevented by protection means, which can be inserted in the compartment 3 and prevent access of the concrete to a portion 3*a* of the compartment 3 which is connected to the main opening 5 and is designed to receive the connecting element 7.

Conveniently, the body of the insert 2 comprises a contoured plate element 8, preferably made of steel, which forms, inside-the compartment 3, shoulders 8*a*, 8*b*, with which the connecting element 7 is to be engaged. Such shoulders 8*a*, 8*b* are arranged laterally and on mutually opposite sides with respect to the main opening 5 and are directed away from the face 4.

The body of the insert 2 has an elongated shape with a substantially constant transverse cross-section, which is, preferably substantially Ω-shaped, in which the main opening 5 is constituted by a slot which is elongated in the direction of the longitudinal extension of the body of the insert 2. In practice, in the illustrated embodiment, the main opening 5 is formed between the two end portions of the Ω, which face each other and end with two coplanar wings 9*a*, 9*b*, which constitute the face 4.

The at least one secondary opening through which the concrete can enter the compartment 3 can be formed at the longitudinal ends of the body of the insert 2, which can be completely open as a consequence of the folded plate-like structure of the body of the insert 2, as in the illustrated embodiment.

As an alternative, or in combination, the secondary openings can be formed on the lateral surface of the body of the insert 2, for example on the sides of the Ω or, as shown, on the back of the Ω, which faces the main opening 5.

In the illustrated embodiment, the secondary openings constituted by the open longitudinal ends of the body of the insert have been designated by the reference numerals 10*a*, 10*b*, while the secondary openings on the back of the body of the insert 2 have been designated by the reference numeral 10*c*.

The secondary openings 10*a*, 10*b*, 10*c* are preferably arranged symmetrically with respect to the central transverse cross-section of the body of the insert 2.

It is possible to provide, on the back of the body of the insert 2, at least two secondary openings 10*c*, located proximate to the longitudinal ends of the body of the insert 2, or at least three secondary openings 10*c*, of which two are located proximate to the longitudinal ends and one is located in an intermediate region of the body of the insert 2.

It should be noted that the number of the secondary openings 10*c*, as well as their shape and arrangement on the body of the insert 2, can vary depending on the degree of connection that is to be provided between the concrete located outside the body of the insert 2 and the concrete located inside it.

Preferably, the protection means comprise an elastically deformable element 11, which can be inserted in the compartment 3 through the main opening 5 or laterally thereto before embedding the anchoring insert 1 in the component 6 and can be removed after the hardening of the concrete.

The elastically deformable element 11 can be constituted for example by a sponge or an elastic pad.

The elastically deformable element 11 can have various shapes, depending on the shape that is to be obtained for the portion 3*a* of the compartment 3 that is not occupied by the concrete and accordingly depending on the shape that is to be obtained for the portions of the compartment 3 that are occupied by the concrete.

The anchoring insert according to the invention can be completed with stiffening means for stiffening the body of the insert 2 proximate to the main opening 5, for example of the type as shown in the published document MI2000A-002792 by the same Applicants. Such stiffening means may comprise a pair of strips or wings rigidly attached by welding, for example to the facing end portion of the Ω, along the main opening 5.

In practice, the anchoring insert according to the invention is designed to be arranged in the formwork of a component, arranged so that its face 4 lies at a face of the component 6 to be provided.

During the casting of the concrete to produce the component 6, the concrete, besides surrounding externally the body of the insert 2, also enters the compartment 3 except for the portion 3*a* occupied by the elastically deformable element 11. After the hardening of the concrete, the elastically deformable element 11 is extracted from the compartment 3, thus freeing the portion 3*a* that is designed to be engaged by the connecting element 7.

The penetration of the concrete of the body of the component 6 within the compartment 3 is extremely important, since it firmly traps the anchoring insert 1 in the body of the component 6, achieving excellent resistance to separation of the insert from the compartment without necessarily resorting to additional anchoring elements which protrude from the insert and without requiring particular shapes which increase the depth of the body of the insert.

Figure 7:
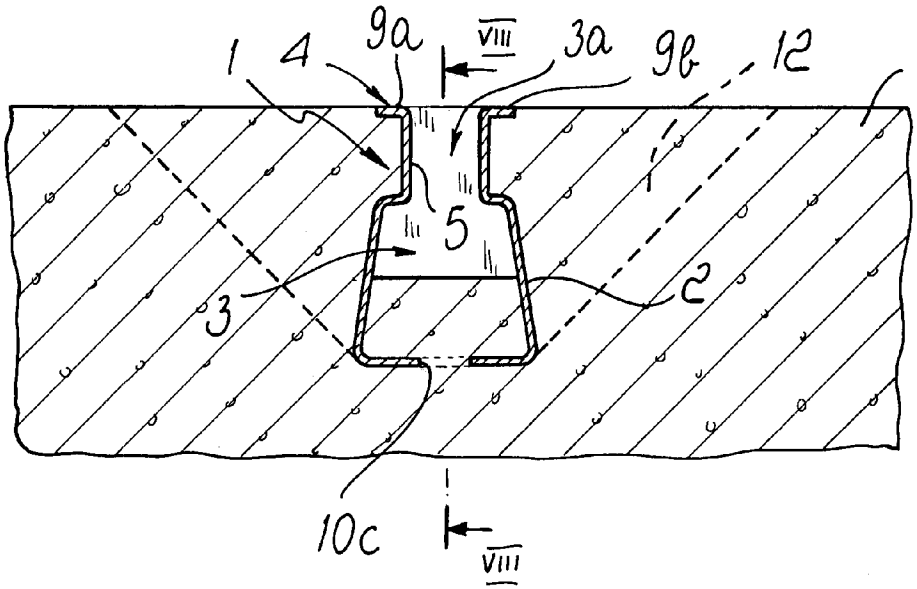
FIG. 7 is a sectional view, taken in a manner similar to FIG. 6, of the concrete cone which contrasts the extraction of the insert from the body of the component.
Figure 8:
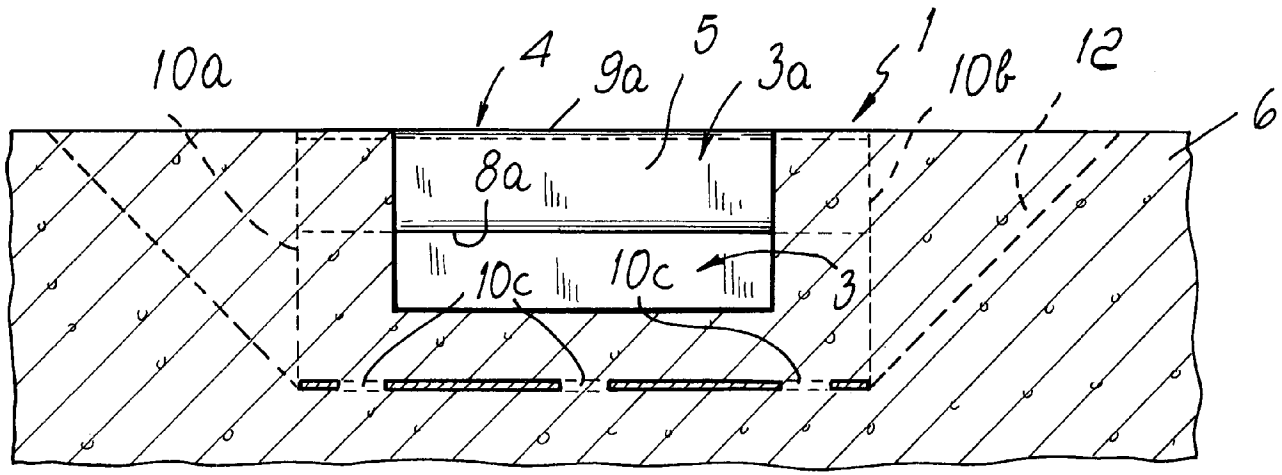
FIG. 8 is a sectional view of FIG. 7, taken along the line VIII-VIII, of the concrete cone which contrasts the extraction of the insert from the body of the component.

It should be noted that the secondary openings, 10*a*, 10*b* and particularly the secondary openings 10*c* provide a sort of tacking between the concrete arranged externally and the concrete arranged inside the body of the insert 2. In this manner, the insert according to the invention is coupled in an optimum manner to the concrete in which it is inserted, which cooperates with the insert in withstanding the stresses transmitted through the insert to the body of the component 6. FIGS. 7 and 8 illustrate schematically a concrete cone 12, which is affected by this transmission of forces and contrasts the extraction of the insert according to the invention. from the body of the concrete component 6.

Thanks to this fact, the anchoring insert according to the invention, for an equal resistance to separation from the concrete component, can have a reduced depth with respect to known types of anchoring inserts.

It should be noted that in the anchoring insert according to the invention the increase in cohesion between the insert and the concrete is achieved by using part of the compartment designed to accomodate the connecting element, in contrast with the general trend in the specific field, which has always been to protect as much as possible such compartment from any infiltration of concrete during the casting of the component.

In practice it has been found that the anchoring insert according to the invention fully achieves the intended aim, since thanks to the partial invasion of the internal compartment of the insert by the concrete it allows to achieve high cohesion with the concrete component even with a limited insert depth.

Another advantage of the insert according to the invention that arises from the high cohesion achieved with body of the concrete component is that it can also be produced with a reduced thickness and therefore allows a substantial saving in production costs.

The anchoring insert thus conceived is susceptible of numerous modifications and variations, all of which are within the scope of the appended claims; all the details may further be replaced with other technically equivalent elements.

In practice, the materials used, although metallic materials are preferred for the manufacture of the anchoring insert, as well as the dimensions, may be any according to requirements and to the state of the art.

What is claimed is:

1. An anchoring insert embedded in a prefabricated concrete component, comprising:

an insert body which encloses a compartment and has a face with a main opening for accessing said compartment, said insert body being embedded in said prefabricated concrete component such that said face of said insert body is arranged substantially flush with a face of said concrete component and such that a remaining part of said insert body is embedded in said concrete component, said remaining part of said insert body comprising a lateral surface and a back that lies opposite with respect to the face on which said main opening is formed, said lateral surface extending between said face on which said main opening is formed and said back of said insert body;

at least one secondary opening provided in said insert body through which casted concrete has entered into said compartment during casting of said prefabricated concrete component, and said compartment being occupied partially by the casted concrete;

an occupied portion of said compartment that is filled with the casted concrete that has entered into said compartment during casting of said prefabricated concrete component through said at least one secondary opening provided in said insert body, wherein said back of said insert body is completely covered by the casted concrete at said occupied portion of said compartment, and said lateral surface of said insert body comprises a covered portion that is covered by the casted concrete at said occupied portion of said compartment;

a receiving portion of said compartment free of any concrete of said prefabricated concrete component, said receiving portion of said compartment being arranged between said main opening and said occupied portion of said compartment, and wherein said lateral surface of said insert body comprises a free portion that is free of concrete at said receiving portion of said compartment;

an elastic protection component arranged in said receiving portion of said compartment and being removable from said receiving portion of said compartment after said prefabricated concrete component has been cast.

2. The anchoring insert embedded in a prefabricated concrete component of claim 1, wherein said insert body comprises a contoured plate-shaped element which forms, inside said compartment, engagement shoulders for engaging a connecting element, said shoulders being arranged laterally and on mutually opposite sides of said lateral surface of said insert body with respect to said main opening.

3. The anchoring insert embedded in a prefabricated concrete component of claim 1, wherein said insert body has an elongated shape with a substantially constant transverse cross-section, said main opening being elongated along a direction that is substantially parallel to a longitudinal extension of said insert body.

4. The anchoring insert embedded in a prefabricated concrete component of claim 1, wherein said face of the insert body in which said main opening is formed is substantially flat and is arranged substantially coplanar with respect to a face of the concrete component that embeds said insert body.

5. The anchoring insert embedded in a prefabricated concrete component of claim 1, wherein said at least one secondary opening is formed at a longitudinal end of said insert body.

6. The anchoring insert embedded in a prefabricated concrete component of claim 1, comprising at least two secondary openings arranged symmetrically with respect to a transverse central cross-section of said insert body.

7. The anchoring insert embedded in a prefabricated concrete component of claim 6, wherein said insert body is shaped with a transverse cross-section substantially shaped like a letter Ω, with said main opening formed between two mutually facing portions of the Ω and with the secondary openings at two open longitudinal ends of said insert body.

8. The anchoring insert embedded in a prefabricated concrete component of claim 7, further comprising stiffening means for stiffening said insert body proximate to said main opening.

9. The anchoring insert embedded in a prefabricated concrete component of claim 8, wherein said stiffening means comprises a pair of strips or wings rigidly connected to the facing portions of the Ω, along said main opening.

10. The anchoring insert embedded in a prefabricated concrete component of claim 1, comprising at least three secondary openings, two of which are arranged proximate to longitudinal ends, and one is arranged in an intermediate region of said insert body.

11. The anchoring insert embedded in a prefabricated concrete component of claim 10, wherein secondary openings are constituted by open longitudinal ends of said insert body.

12. The anchoring insert embedded in a prefabricated concrete component of claim 1, wherein said at least one secondary opening is formed on said lateral surface of said insert body.

13. The anchoring insert embedded in a prefabricated concrete component of claim 1, wherein said at least one secondary opening is formed on said back of said insert body that lies opposite with respect to the face on which said main opening is formed.

14. The anchoring insert embedded in a prefabricated concrete component of claim 1, wherein said protection means comprises an elastically deformable element, which can be inserted in said compartment through said main opening before embedding the anchoring insert in the concrete component, said elastically deformable element being further removable from said compartment after hardening of the casted concrete.

* * * * *